US005790087A

United States Patent [19]

Shigeta et al.

[11] Patent Number: 5,790,087

[45] Date of Patent: Aug. 4, 1998

[54] METHOD FOR DRIVING A MATRIX TYPE OF PLASMA DISPLAY PANEL

[75] Inventors: Tetsuya Shigeta; Nobuhiko Saegusa; Masahiro Suzuki, all of Koufu, Japan

[73] Assignee: Pioneer Electronic Corporation, Tokyo, Japan

[21] Appl. No.: 632,127

[22] Filed: Apr. 15, 1996

[30] Foreign Application Priority Data

Apr. 17, 1995 [JP] Japan ..... 7-090977
Mar. 15, 1996 [JP] Japan ..... 8-059600

[51] Int. Cl.[6] ..... G09G 3/28

[52] U.S. Cl. ..... 345/67; 345/62

[58] Field of Search ..... 345/60, 62, 65, 345/66, 67, 71, 72, 208; 315/169.4, 335

[56] References Cited

U.S. PATENT DOCUMENTS 5,420,602 5/1995 Kanazawa ..... 345/67
5,656,893 8/1997 Shino et al. ..... 315/169.4
5,659,226 8/1997 Shigeta ..... 315/169.4

*Primary Examiner*—Jeffery Brier
*Attorney, Agent, or Firm*—Sughrue, Mion, Zinn, Macpeak & Seas, PLLC

[57] ABSTRACT

A method for driving a plasma display panel (PDP) to indicate a precise emission image corresponding to pixel data thereon. The method comprises the steps of applying first priming pulses to all of the row electrodes simultaneously to execute a simultaneous priming stage, and then applying a second pulse for reproducing charged particles in the discharge region just before applying a scan pulse for writing pixel data to the pixel cell, thereby writing the pixel data to the respective pixel cells. In other words, the application of the second priming pulse can adjust the amount of charged particles in the discharge region of the pixel cell just before applying the scan pulse to write the pixel data. Therefore, the desired amount of barrier charge corresponding to the contents of the pixel data can be achieved in the pixel cell, thereby obtaining a precise display image on the PDP panel.

10 Claims, 11 Drawing Sheets

METHOD FOR DRIVING A MATRIX TYPE OF PLASMA DISPLAY PANEL

BACKGROUND OF THE INVENTION

1. Field of the Invention

This invention relates to a method for driving an AC discharge and matrix type of plasma display panel.

2. Description of the Related Background Art

A plasma display panel is well-known as one type of thin two-dimensional display, and a lot of researches and studies have recently been conducted on the plasma display panels. An AC discharge and matrix type of plasma display panel having a memory function is well-known as one such plasma display panel.

FIG. 1 shows a schematic diagram of a plasma display apparatus including a plasma display panel.

Referring to FIG. 1, a driving apparatus 100 receives video signals and converts a set of the received video signals for every pixel to digital pixel data. The driving apparatus 100 then generates pixel data pulses corresponding to the pixel data to apply the pixel data pulses to column electrodes D1–Dm in the plasma display panel 11 (designated as PDP hereinafter). The PDP 11 comprises column electrodes D1–Dm, and row electrodes X1–Xn and Y1–Yn extending perpendicularly to the column electrodes, in which two adjacent ones of the row electrodes Xi and Yi are paired to one another to form a row of the display on the display panel. The PDP further includes a dielectric layer formed between the column and row electrodes. A cross section in which a pair of row electrodes and a column electrode cross each other constitutes a single pixel cell.

The driving apparatus 100 produces priming pulses $PP_x$ and $PP_y$ for all of the row electrodes in the PDP 11 and then applies the pulses $PP_x$ and $PP_y$ to the respective row electrodes X1–Xn, and Y1–Yn to forcibly cause a discharge between a pair of row electrodes Xi and Yi for generating (or destroying) barrier-charge within the pixel cell. The driving apparatus 100 also generates a scan pulse SP for writing the pixel data in the PDP 11, and sustain pulses IPx and IPy for sustaining a discharge emission, an erasing pulse EP for ceasing a sustained discharge emission, thereby applying these pulses to the row electrodes X1–Xn, and Y1–Yn in the PDP 11.

FIG. 2 shows the timings for applying the above various types of driving pulses to the row electrodes.

Referring to FIG. 2, The driving apparatus 100 supplies all of the row electrodes $X_1$–$X_n$ with the priming pulses PPx which have a negative potential, and simultaneously supplies all of the row electrodes $Y_1$–$Y_n$ with the priming pulses $PP_y$ which have a positive potential. The application of the priming pulses causes discharges between the pair of row electrodes in all of the pixel cells of the PDP 11. The discharge produces charged particles in each of the pixel cells. After the disappearance of the discharge, the barrier charge remains in the dielectric layer (simultaneous priming step).

The driving apparatus 100 then applies pixel-data pulses $DP_1$–$DP_n$ corresponding to pixel data at every row to the column electrodes $D_1$–$D_m$ in turn. The driving apparatus 100 synchronizes the timing for applying the scan pulse SP with the timing for applying the pixel data pulses $DP_1$–$DP_n$, thereby applying the scan pulse SP to the row electrodes $Y_1$–$Y_n$ in turn. At this moment, discharge occurs in the only pixel cell in which both of the scan pulse SP and the pixel data pulse DP are simultaneously applied to the row and column electrodes, respectively, so that most of the barrier charge which has been generated by the simultaneous priming step disappears. On the contrary, no discharge occurs within the pixel cell in which a pixel data pulse is not applied but only a scan pulse SP is applied, so that a desired amount of the barrier charge which has been generated by the simultaneous priming step is left in the cell. In other words, the desired amount of barrier charge in the cell which has been produced by the simultaneous priming step is selected in accordance with the contents of the pixel data to be lost (pixel data selecting step).

The driving apparatus 100 then applies a series of sustain pulses $IP_X$, each of which has a positive polarity, to the row electrodes $X_1$–$X_n$, and applies a series of further sustain pulses $IP_y$, each of which has a positive polarity, to the row electrodes $Y_1$–$Y_n$ at the offset timings from those of the sustain pulses $IP_x$. The only pixel cells which hold the barrier charge maintain the discharge emissions (sustain discharge step).

The driving apparatus 100 then applies erasing pulses to the respective row electrodes $Y_1$–$Y_n$ to cease the discharge emissions (sustain discharge ceasing step).

In the plasma display apparatus mentioned above, all of the pixel cells have a desired amount of charged particles which has been produced by the simultaneous priming step in the respective discharge regions. Therefore, the scan pulse SP having narrower pulse duration enables a discharge to be caused in the cell.

However, the amount of charged particles in the cell decreases gradually as time elapses. The cell on the n-th row, to which the scan pulse is applied in the n-th or the last place, has only a small amount of charged particles in the discharge region just before applying the scan pulse.

Because the above pixel cell has only a small amount of charged particles, it often happens that the discharge does not occur in response to the application of both the pixel data pulse DP, which has a narrower pulse duration, and the scan pulse. As a result, the barrier charge corresponding to the pixel data may not be produced in the cell.

Accordingly, the problem arises that an erroneous emission display appears on the PDP.

OBJECTS OF THE INVENTION

The main object of the invention is to provide a method for driving a matrix type of plasma display panel which is able to indicate an emission display associated with the pixel data precisely.

SUMMARY OF THE INVENTION

The aforementioned problems are overcome and advantages are provided by a method for driving a matrix type of plasma display panel according to the present invention. The plasma display panel includes a plurality of row electrodes extending parallel to each other, two adjacent ones of said row electrodes being paired, and a plurality of column electrodes extending perpendicularly to the row electrodes at given intervals. A region in which one pair of the row electrodes and one column electrode cross each other corresponds to one pixel. The method includes the steps of: applying first priming pulses to all of the row electrodes simultaneously to cause discharges between all of the pairs of row electrodes, applying a second priming pulse to one of the pair of row electrodes to cause discharge therebetween just before applying a scan pulse to the one of the pair of row electrodes for writing pixel data to the associated pixels in accordance with pixel data pulses which are simultaneously applied to the column electrodes, applying a series of sustain pulses alternately first to one of the row electrode pair and then to the other thereof to maintain sustain discharge between the pair of row electrodes, and applying an erasing pulse to one of the pair of row electrodes to stop the sustain discharge.

After applying the first priming pulses to all of row electrodes simultaneously, to execute a simultaneous priming stage, a second priming pulse for reproducing charged particles in the discharge region and a scan pulse for writing the pixel data to the pixel cell are applied to a pair of row electrodes in turn, thereby writing the pixel data at every row.

BRIEF DESCRIPTION OF THE DRAWINGS

The aforementioned aspects and other features of the invention are explained in the following description, taken in connection with the accompanying drawing figures wherein.

For a better understanding of the invention reference is made to the following detailed description of the preferred embodiments.

DETAILED DESCRIPTION OF THE PREFERRED EMBODIMENTS

Preferred embodiments of the present invention will now be described with reference to FIGS. 3–11.

Figure 1:
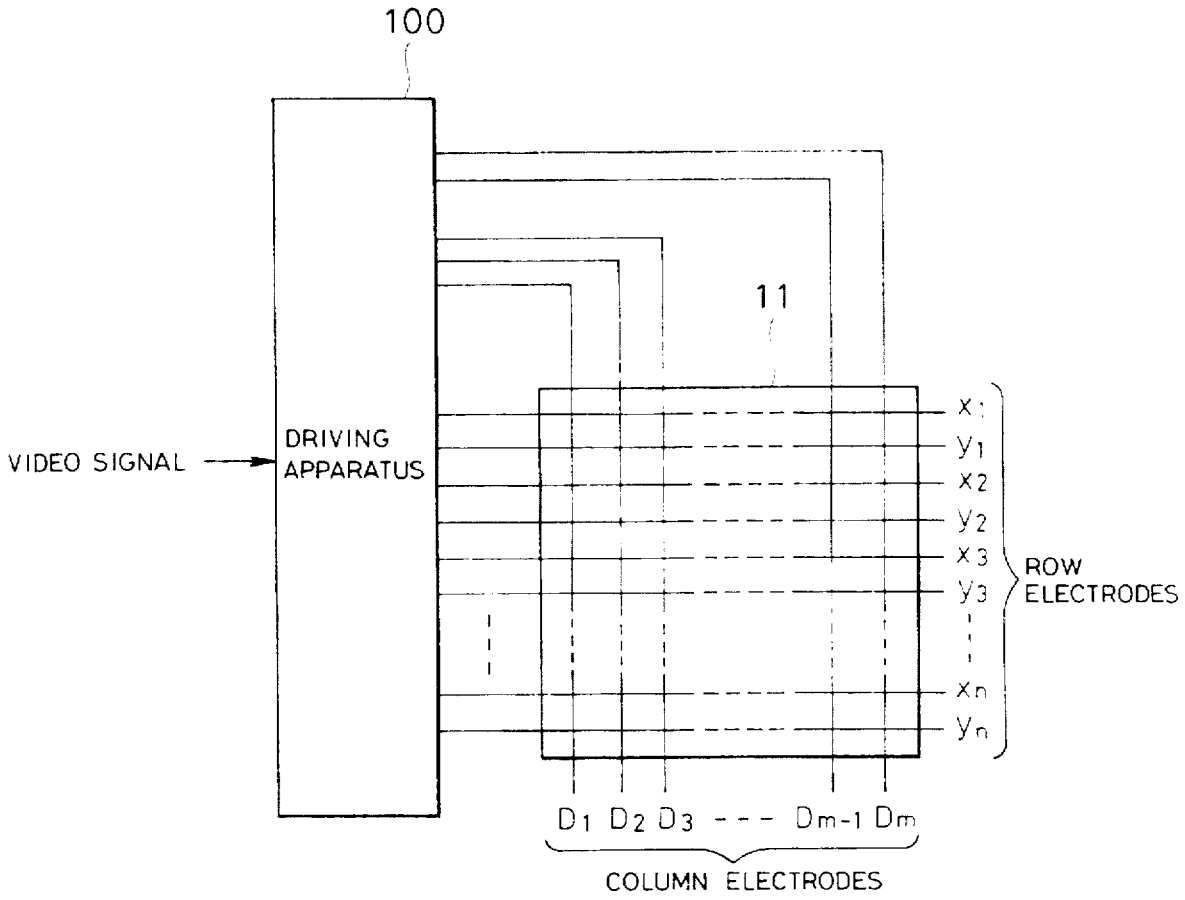
FIG. 1 is a schematic diagram showing a plasma display apparatus including a matrix type of plasma display panel.
Figure 2:
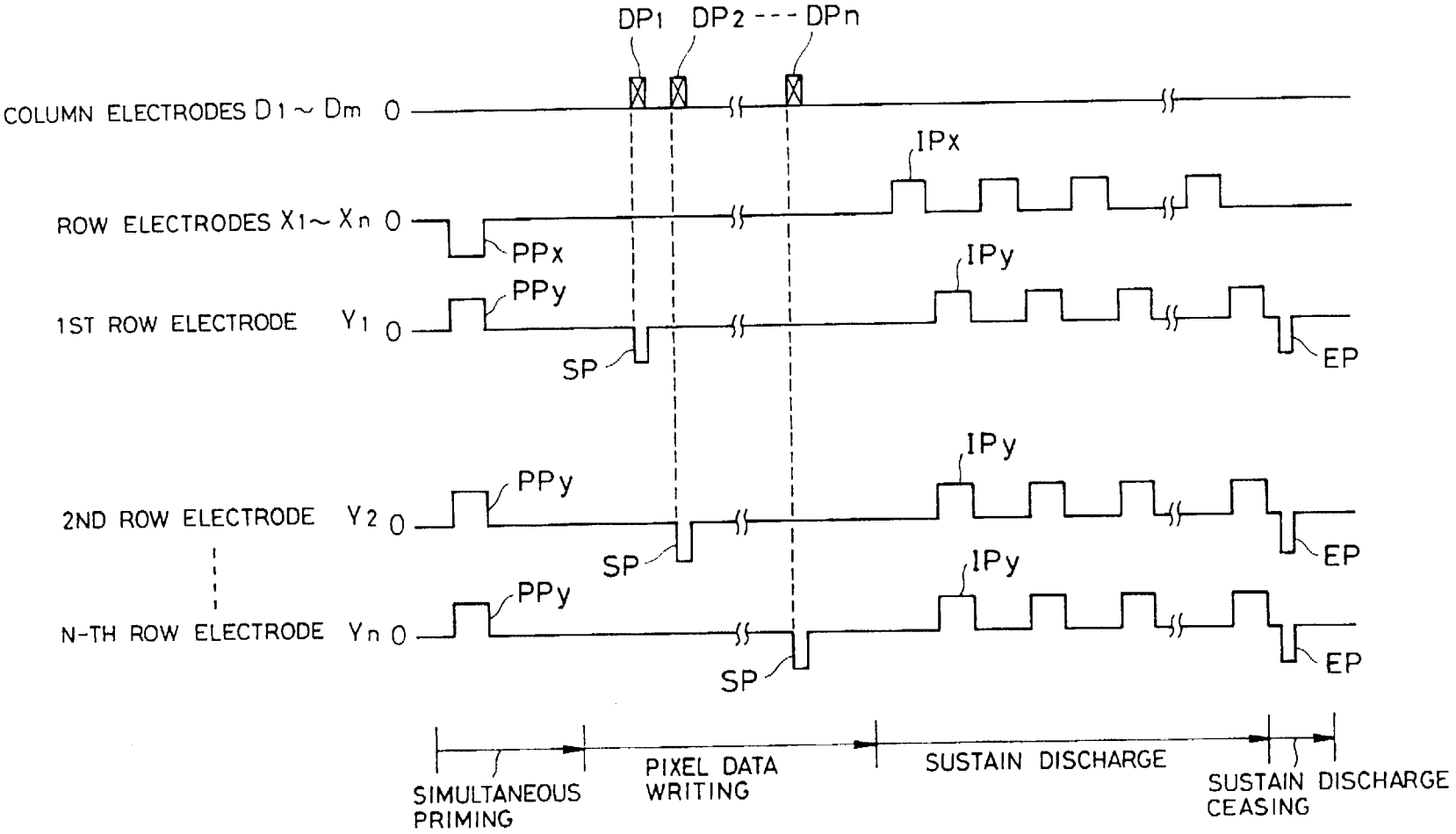
FIG. 2 PRIOR ART
FIG. 2 is a waveform chart showing the timing for applying a driving pulse to the respective electrode by means of a conventional technique for driving a plasma display panel.
Figure 3:
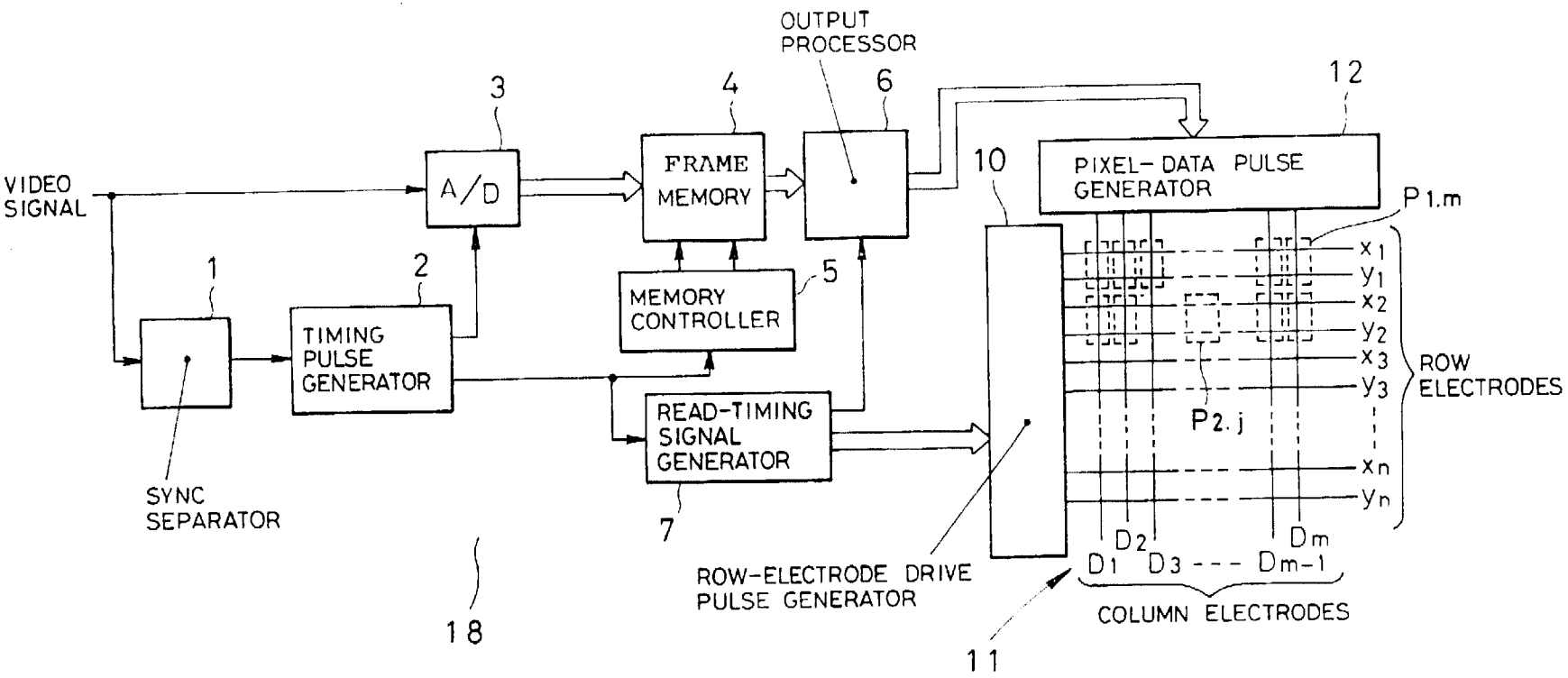
FIG. 3 is a block diagram showing a plasma display apparatus.

FIG. 3 is a block diagram showing a plasma display apparatus including a driving apparatus for driving a plasma display panel by means of the driving technique according to the invention.

Referring to FIG. 3, a sync separator 1 receives input video signals and then extracts horizontal and vertical synchronous signals from the received input video signals to supply the extracted synchronous signals to a timing pulse generator 2. The timing pulse generator 2 produces an extracted synchronous-signal-timing-pulse on the basis of the extracted horizontal and vertical synchronous signals to supply the produced extracted synchronous-signal-timing-pulse to an A/D converter 3, a memory controller 5, and a read-timing signal generator 7. The A/D convertor 3 converts input video signals per pixel to digital pixel data synchronizing with the extracted synchronous-signal-timing pulse to provide the converted digital pixel data to a frame memory 4. The memory controller 5 supplies write and read pulses synchronous with the extracted synchronous-signal-timing-pulse to the frame memory 4. The frame memory 4 receives pixel data supplied from the A/D converter 3 in turn in response to the received write signal. The frame memory 4 also reads out the pixel data which have been stored in the frame memory 4 in turn to supply the pixel data to an output processor 6. The read-timing signal generator 7 generates various types of timing signals for controlling the operation for discharge emissions to supply these timing signal to a row electrode driving pulse generator 10 and the output processor 6. The output processor 6 receives the pixel data from the memory 4 to supply the received pixel data to a pixel data pulse generator 12 synchronizing with the timing signal from the read timing signal generator 7.

The pixel data pulse generator 12 receives pixel data supplied from the output processor 6 to generate the pixel data pulses DP corresponding to the received pixel data, thereby applying the pixel data pulses DP to the column electrodes $D_1$–$D_m$ in the PDP 11.

The row electrode driving pulse generator 10 generates first priming pulses $PP_x$ and $PP_y$ for causing the discharge between all of the pairs of row electrodes in the PDP 11 to produce charged particles in the discharge region of the PDP, a second priming pulse PP for reproducing charged particles, a scan pulse SP for writing the pixel data to the associated pixels, a series of sustain pulses $IP_x$ and $IP_y$ for sustaining the discharge emissions in the pixel cell, and an erasing pulse EP for ceasing the sustained discharge emission. The generator 10 applies these pulses to the row electrodes $X_1$–$X_n$ and $Y_1$–$Y_n$ in response to each of the various types of timing signals supplied from the read-timing signal generator 7.

Figure 4:
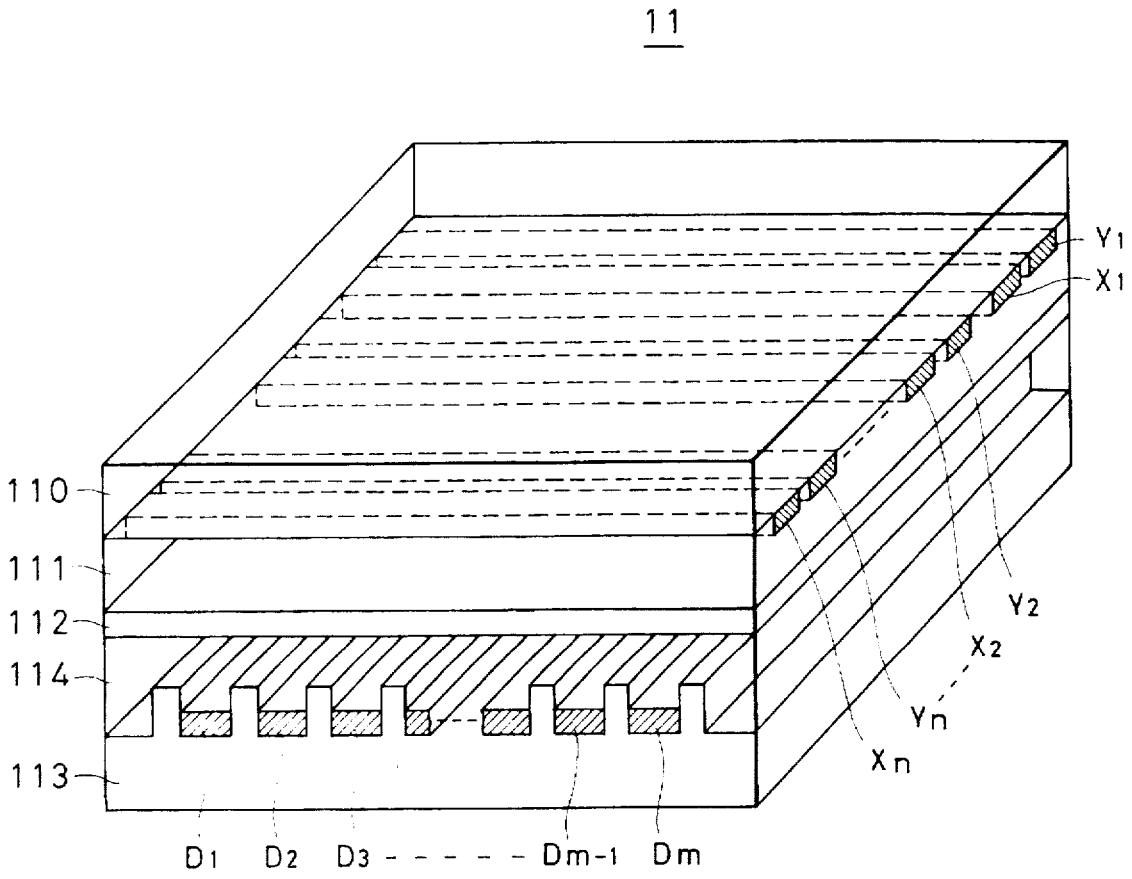
FIG. 4 is a perspective view showing a plurality of pixel cells in a plasma display.

FIG. 4 shows a schematic diagram of the construction of the PDP 11.

Referring to FIG. 4, a front substrate 110 made of glass is arranged parallel to a back substrate 113 made of glass. The row electrodes $X_1$–$X_n$ and $Y_1$–$Y_n$ are formed on an internal surface of the front substrate 110 which faces the back substrate 113 at an interval. A set of adjoining row electrodes $X_i$ and $Y_i$ ($1 \leqq i \leqq n$) are combined to provide a pair. The row electrodes are covered with a dielectric layer 111. A MgO (Magnesium oxide) layer 112 is deposited on the dielectric layer 111. The discharge region 114 is provided between the MgO layer 112 and the back substrate 113. The column electrodes $D_1$–$D_m$ are formed on the back substrate 113 with a fluorescent layer covering. In the above arrangement, a pair of row electrodes $X_i$ and $Y_i$ ($1 \leqq i \leqq n$) are combined to function to display one row of an image appearing on the display surface. Furthermore, a section in which a pair of row electrodes and a column electrode cross each other at an interval provides one pixel cell $P_{i,j}$ on the display surface.

The following description is made for a method of a preferred embodiment for driving a matrix type of plasma display panel utilizing the plasma display apparatus shown in FIG. 3.

Figure 5:
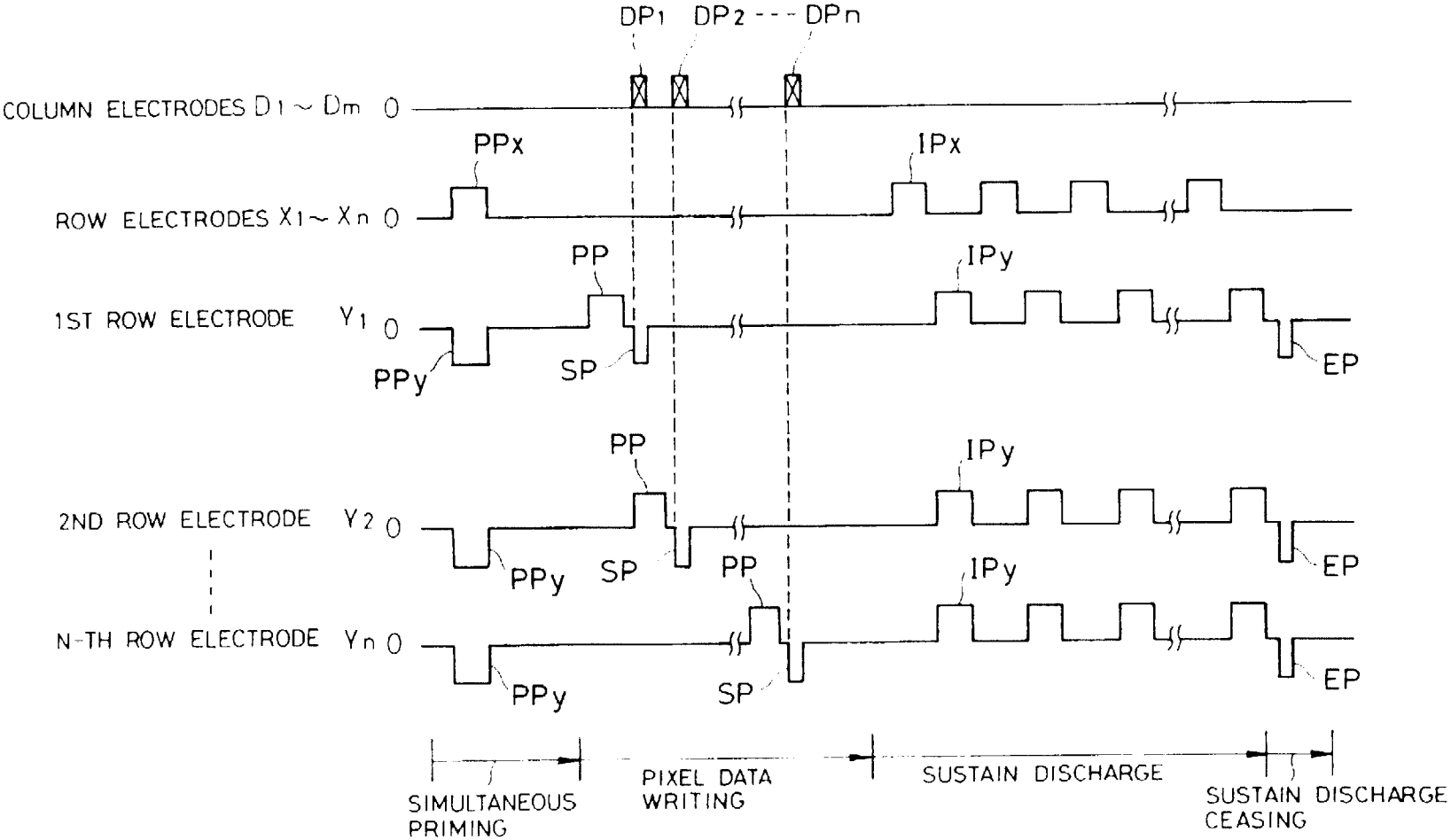
FIG. 5 is a waveform chart of a driving technique of a preferred embodiment according to the present invention, which shows the timing for applying a driving pulse to the respective electrode.

FIG. 5 shows a waveform chart illustrating a first preferred embodiment of the method according to the invention, which describes the timing for applying the various pulses to the PDP 11.

Referring to FIG. 5, at first, the row electrode driving pulse generator 10 applies first priming pulses $PP_x$, having a positive potential to all of the row electrodes $X_1$–$X_n$, and simultaneously applies further first priming pulses $PP_y$ having a negative potential to all of the row electrodes $Y_1$–$Y_n$. The application of the first priming pulses causes discharges in all of the gaps between the row electrodes in the PDP 11, so that charged particles are produced in the discharge regions 114 of all of the pixel cells $P_{i,j}$. After the termination of the discharge, a given amount of the barrier charge is stored in the dielectric layer 111 of the pixel cells. (simultaneous priming step)

The pixel data pulse generator 12 then applies the pixel data pulses $DP_1$–$DP_n$ having positive potential and associated with the pixel data per row to the column electrodes $D_1$–$D_m$ in turn. In a preferred embodiment, the row electrode driving pulse generator 10 applies scan pulses SP which have relatively shorter pulse duration to the row electrodes $Y_1$–$Y_n$, synchronizing with the application of the data pulses $DP_1$–$Dp_n$. The row electrode driving pulse generator 10 applies second priming pulses PP which have positive potential as shown in FIG. 5 to the row electrodes $Y_1$–$Y_n$, just before the row electrode driving pulse generator 10 applies the scan pulses SP to the row electrodes $Y_1$–$Y_n$.

The number of charged particles which have been generated by means of the simultaneous priming is reduced gradually with the elapse of the time period. However, the application of the second priming pulses again generates or reproduces charged particles in the discharge region to leave the charged particles therein. Therefore, the scan pulses are applied to the row electrodes to write pixel data in the condition that a desired amount of charged particles remains in the discharge region 114.

If the contents of the pixel data equal a logical level of "0", both the scan pulse SP and the pixel data pulse DP are applied to the respective electrodes in the cell simultaneously, so that the barrier charge within the pixel cell is destroyed. If the contents of the pixel data equal a logical level of "1", only the scan pulse SP is applied to the electrodes in the cell, so that the barrier charge is kept with no changes. In other words, the scan pulse SP is a selective erasing pulse which triggers to selectively erase the barrier charge remaining within the pixel cell in accordance with the pixel data. (pixel data writing step)

Then, the row electrode driving pulse generator 10 applies a series of sustain pulses $IP_x$ having positive voltage to the row electrodes $X_1$–$X_n$ and applies a series of further sustain pulses $IP_y$ having positive voltage to the row electrodes $Y_1$–$Y_n$ at timings different from those for the sustain pulses $IP_x$. During the period in which the sustain pulses are applied successively, only the pixel cells that have the barrier charge maintain discharge emissions. (sustain discharge step)

Then, the row electrode driving pulse generator 10 applies erasing pulses EP to the respective row electrodes $X_1$–$X_n$ to cease the sustain discharges. (sustain discharge ceasing step)

Described above, when the plasma display panel is driven, the first priming pulses are applied to all of the row electrodes simultaneously to perform a simultaneous priming operation, and then the second priming pulses for reproducing charged particles in the discharge regions and scan pulses for writing pixel data are applied successively to the row electrodes, thereby writing pixel data to the pixel cells every row.

Accordingly, the period from the time of reproduction of the charged particles by the second priming pulse to the time of writing pixel data becomes shorter, and the period for every row is the same for all of rows. Therefore, when all of the pixel cells in the PDP have the same amount of charged particles in the respective discharge region 114, the application of the scan pulse enables the pixel data to be written in the associated pixel cell, thereby ensuring the accurate writing of the pixel data.

Though the second priming pulse having positive voltage is applied to one of the pair of row electrodes and then the scan pulse having negative voltage is applied to the same electrode in the above disclosed embodiment, it should be understood that the present invention is not limited to the above waveform charts and the constitutions.

Figure 6:
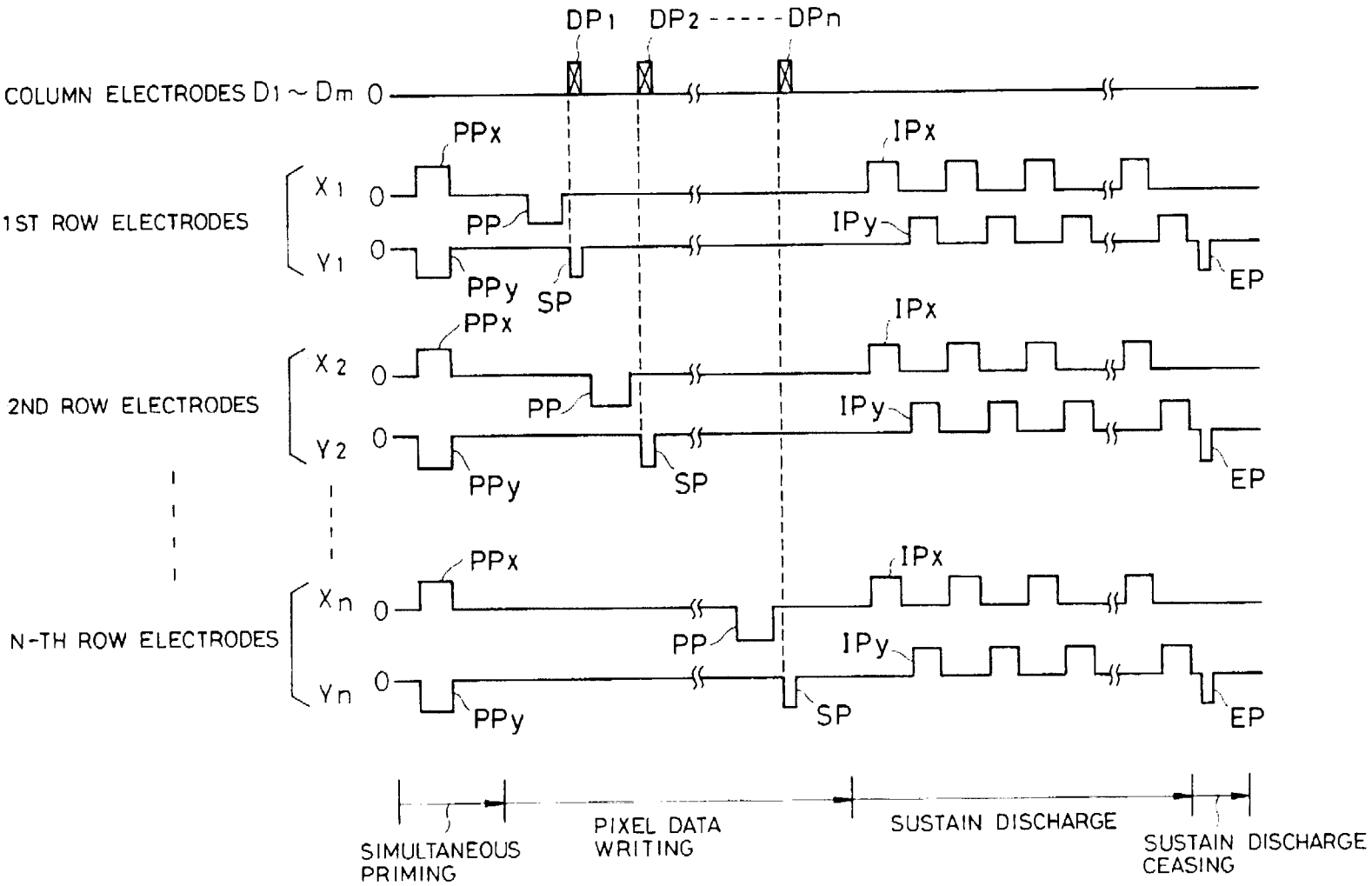
FIGS. 6 and 7 are waveform charts of a driving technique according to other preferred embodiments of the present invention, each of which shows the timing for applying a driving pulse to the respective electrode.
Figure 7:
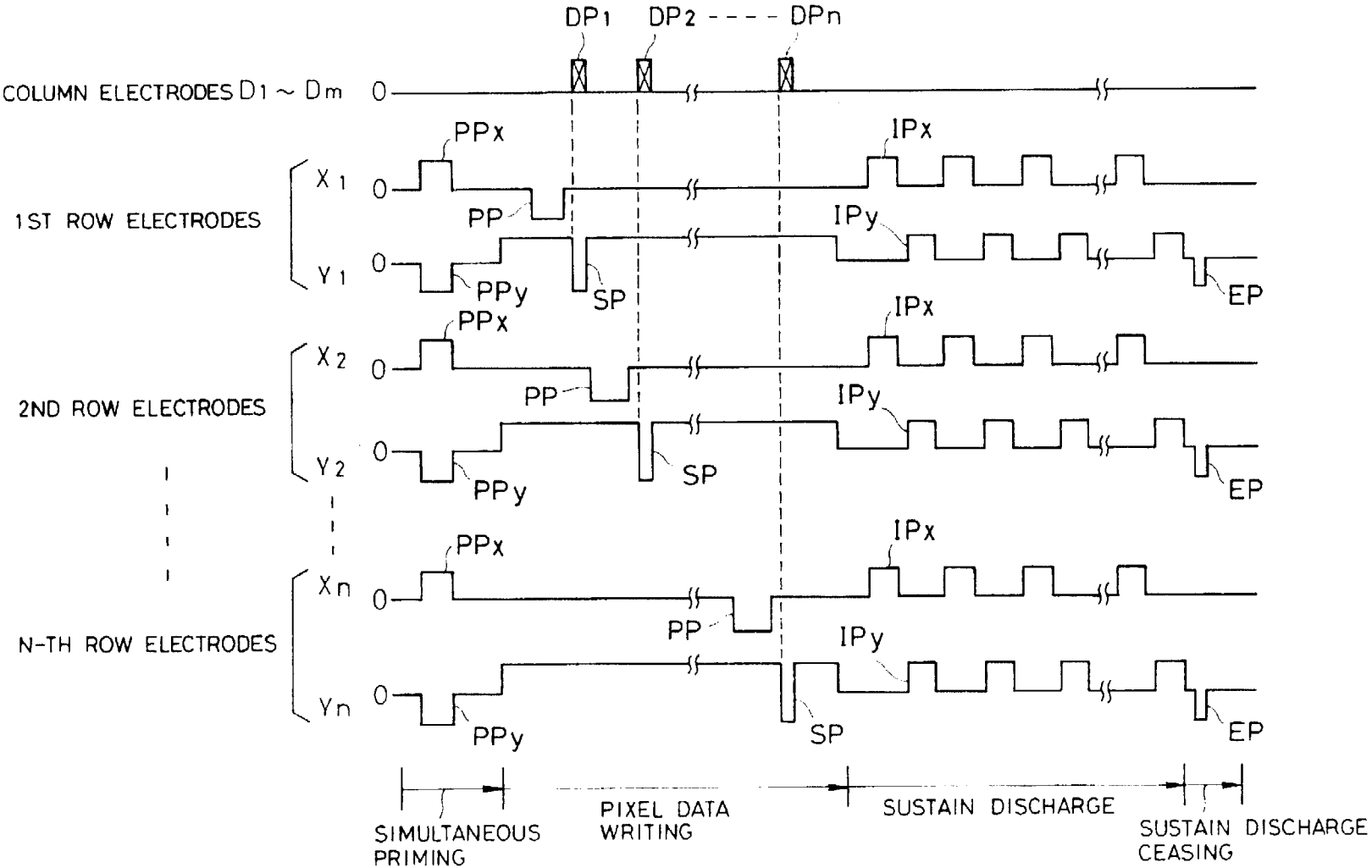

FIGS. 6 and 7 show waveform charts of the timings for applying the driving pulses by means of the driving technique as second and third preferred embodiments of the invention, respectively.

In the preferred embodiments shown in FIGS. 6 and 7, the row electrode driving pulse generator 10 serves to apply a second priming pulse having negative potential PP to the row electrode $X_i$ of the pair, and then to apply a scan pulse having negative potential SP to the row electrode $Y_i$, thereby scanning the pixel data at every row.

Referring to FIG. 7, during the period in which the pixel data are written in the pixel cells by the application of the pixel data pulses $DP_1$–$DP_n$, the potentials of the row electrodes $Yi$ are offset toward the positive side.

In the preferred embodiments described above, after the simultaneous priming step is implemented by the application of the first priming pulses to all of the row electrodes, the second priming pulse is applied to the row electrode just before applying the scan pulse thereto for writing the pixel data, thereby writing the pixel data to the respective rows. In other words, the application of the second priming pulse adjusts the amount of charged particles in the discharge region of the pixel cell just before applying the scan pulse to write the pixel data. Therefore, the desired amount of barrier charge corresponding to the contents of the pixel data can be achieved in the pixel cell, thereby obtaining a precise display image on the PDP panel.

Furthermore, it is found out that adjusting the waveform of the priming pulse makes an image on the PDP panel clearer, in conjuction with the method for applying the first and second priming pulses.

The following description is made for illustrating preferred embodiments for adjusting the waveform of the priming pulses to drive a plasma display panel.

Figure 8:
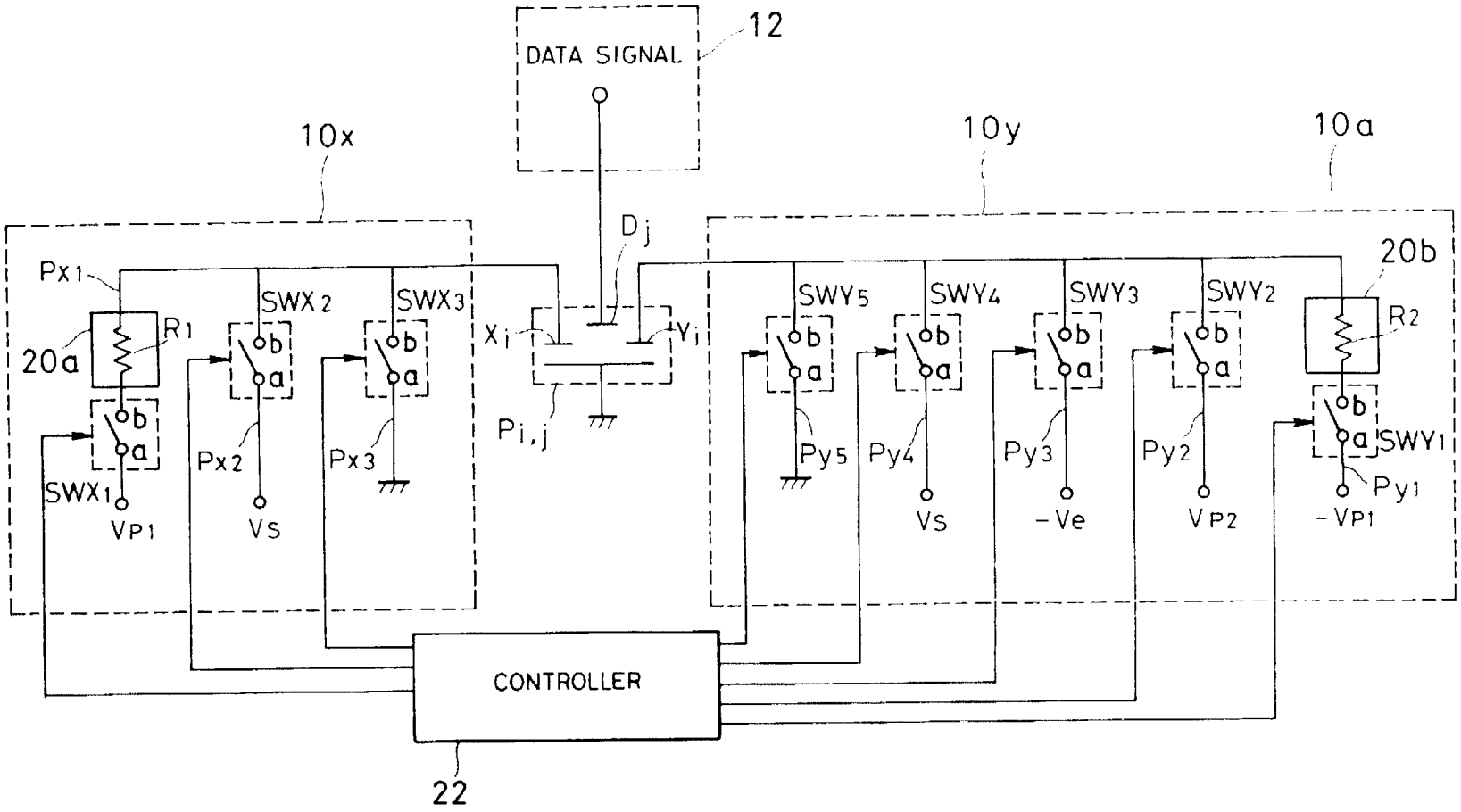
FIG. 8 is a schematic diagram showing a driving apparatus and a pixel cell in a plasma display apparatus.

FIG. 8 shows the detailed block diagram of a row-electrode driving pulse generator 10*a* as one apparatus for adjusting the waveforms of the priming pulses to drive the plasma display panel. It is noticed that the apparatuses except for the row electrode driving pulse generator 10*a* are similar to those of FIG. 3.

Referring to FIG. 8, the row electrode driving pulse generator 10*a* comprises a row-electrode X driving section 10*x*, a row-electrode Y driving section 10*y*, and controller 22. A single pixel cell $P_{i,j}$ includes a pair of row electrodes $X_i$ and $Y_i$ and a column electrode $D_j$. The row electrode $X_i$ is connected electrically to the row-electrode X driving section 10*x*, while the row electrode $Y_i$ is connected electrically to the row-electrode Y driving section 10*y*. The column electrode $D_j$ is connected electrically to the pixel-data pulse generator 12.

The row electrode driving pulse generator 10*a* generates the following pulses for driving the pixel cell;

first priming pulses $PP_x$ and $PP_y$ for causing discharges between all of the pairs of row electrodes to produce charged particles in the discharge region, a second priming pulse PP for reproducing the charged particles in the discharge region, a scan pulse SP for writing pixel data, sustain pulses $IP_x$ and $IP_y$ for maintaining the discharge emissions, and an erasing pulse EP for ceasing the sustain discharge emissions. The row electrode driving pulse generator 10*a* then applies these pulses to the row electrodes $X_1$–$X_n$ and $Y_1$–$Y_n$ of the PDP 11 in response to the various timing signals supplied from the read-timing signal generator 7.

The controller 22 controls the operation including the application of the pulses and the switching of switches described below.

The row-electrode X driving section 10*x* comprises a plurality of switching current paths Px1–Px3 connected in parallel to one another, as shown in FIG. 8. Each of the switching current paths Px1–Px3 includes the corresponding one of switches SWX1–SWX3 connected therein in series. The switches SWX1–SWX3 are switched by an instruction transmitted from the controller 22.

The switching current path Px1 comprises a current limiter 20*a* and the switch SWX1 connected in series. The switch SWX1 includes a contact 'a' connected to a first positive potential $+V_{p1}$, and a contact 'b' connected to the row electrode $X_i$ through a current limiter 20*a*. The switch SWX1 is closed in response to the first priming pulse $PP_x$ supplied from the controller 22 to apply the potential $+VP_{p1}$ to the row electrode $X_i$ through the current limiter 20*a*. In a preferred embodiment, the current limiter 20*a* comprises a resistor having the level of a resistance $R_1$.

Referring to the switching current path Px2, the switch SWX2 includes a contact 'a' connected to a positive potential $+V_s$, and a contact 'b' connected to the row electrode X*i*. The switch SWX2 is closed in response to a sustain pulse $IP_x$ supplied from the controller 22 to apply the potential $+V_s$ to the row electrode $X_i$.

Referring to the switching current path Px3, the switch SWX3 includes a contact 'a' connected to the GND potential and a contact 'b' connected to the row electrode $X_i$. Only when both of the switches SWX1 and SWX2 are open at the same time, the switch SWX3 is closed to apply the GND potential to the row electrode $X_i$.

The row-electrode Y driving section 10*y* has the similar structure to the row-electrode X driving section 10*x*, and comprises a plurality of switching current paths Py1–Py5 connected in parallel to one another. The switching current paths Py1–Py5 include respective switches SWY1–SWY5 connected therein in series. The respective switches SWY1–SWY5 are switched in response to an instruction from the controller 22.

The switching current path Py1 comprises a current limiter 20*b* and the switch SWY1 connected in series. The switch SWY1 has a contact 'a' connected to a negative potential $-V_{p1}$, and a contact 'b' connected to the row electrode $Y_i$ through the current limiter 20*b*. The switch SWY1 is closed in response to the first priming pulse $PP_y$ supplied from the controller 22 to apply the potential $-V_{p1}$ to the row electrode $Y_i$ through the current limiter 20*b*. In a preferred embodiment, the current limiter 20*b* is a resistor having the level of a resistance $R_2$.

Referring to the switching current path Py2, the switch SWY2 has a contact 'a' connected to a positive potential $+V_{p2}$, and a contact 'b' connected to the row electrode $Y_i$. The switch SWY2 is closed in response to the second priming pulse PP supplied from the controller 22 to apply the potential $+V_{p2}$ to the row electrode $Y_i$.

Referring to the switching current path Py3, the switch SWY3 has a contact 'a' connected to a negative potential $-V_e$ for selecting the pixel data, and a contact 'b' connected to the row electrode $Y_i$. The switch SWY3 is closed in response to the scan pulse SP supplied from the controller 22 to apply the potential $-V_e$ to the row electrode $Y_i$.

Referring to the switching current path Py4, the switch SWY4 has a contact 'a' connected to a positive potential +Vs for maintaining a discharge state, and a contact 'b' connected directly to the row electrode $Y_i$. The switch SWY4 is closed in response to the sustain pulse $IP_y$ supplied from the controller 22 to apply the potential +Vs to the row electrode $Y_i$.

Referring to the switching current path Py5, the switch SWY5 has a contact 'a' connected to the GND potential and a contact 'b' connected directly to the row electrode $Y_i$. Only when all of the switches SWY1–SWY4 are open at the same time, the switch SWY5 is closed to apply the GND potential to the row electrode $Y_i$.

The pixel-data pulse generator 12 supplies the column electrodes $D_j$ with a data signal which has the associated level to what is displayed by the pixel P*i,j*.

Described above, the row-electrode drive pulse generator 10*a* has the above structures for the respective pixel cells $P_{i,j}$.

In a preferred embodiment, when the current limiters 20*a*, 20*b* consist of resistors, it is preferable that the resistors would have resistances of the order of kΩ.

The operation using the above-described structure will now be discussed hereinbelow.

Figure 9:
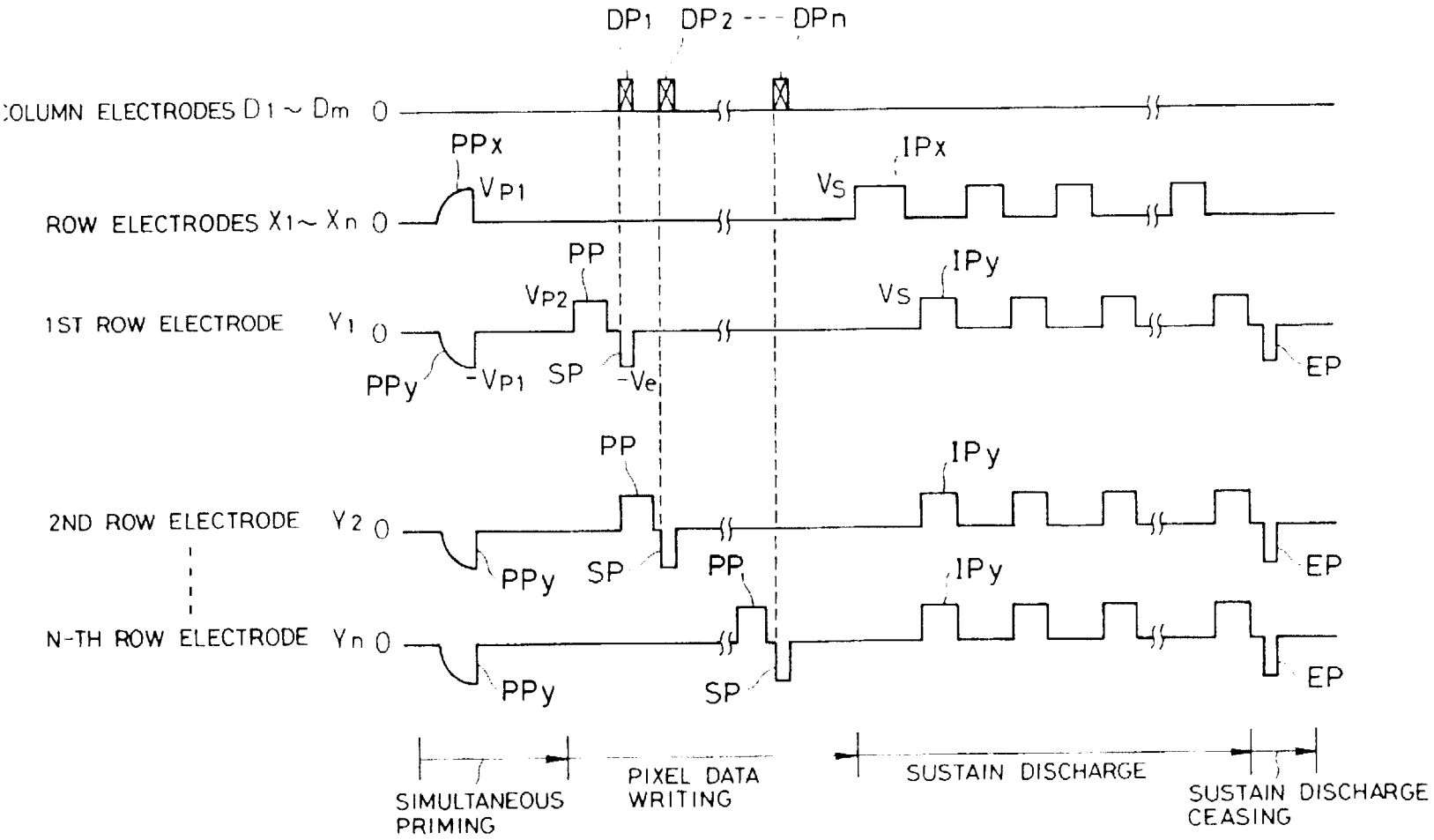
FIGS. 9–11 are waveform charts of a driving technique according to further preferred embodiments of the invention, each of which shows the timing for applying a driving pulse to the respective electrode.

FIG. 9 shows waveform charts of the various pulses applied to the PDP 11 in order to drive the plasma display panel in a fourth preferred embodiment of the invention.

Referring to FIG. 9, the row electrode driving pulse generator 10*a* applies the first priming pulses having positive potential $PP_x$ to all of the row electrodes $X_{1-n}$, and simultaneously applies further first priming pulses having negative potential $PP_y$ to all of the row electrodes $Y_1$–$Y_n$. At this moment, the switches SWX1 and SWY1 are closed, and therefore, the potential $+V_{p1}$ is applied to the row electrode $X_i$ through the current limiter 20*a*, and the potential $-V_{p1}$ is applied to the row electrode $Y_i$, through the current limiter 20*b*. When the potential difference between each of the pairs of row electrodes applied with the potentials $+V_{p1}$ and $-V_{p1}$ respectively exceeds the discharge start voltage, the discharges occur between all of the pairs of row electrodes, thereby producing charged particles in the discharge regions 114 of all of the pixel cells $P_{i,j}$. After the discharge terminates, a predetermined amount of barrier charge is generated to remain in the dielectric layer 111 (simultaneous priming step).

In general, in cells to which a pulsed voltage has been applied, the discharge occurs and then the cell emits light instantaneously. In this case, the luminance of the emitted light has a nearly linear relation with the amount of the discharge current which is generated by the discharge to flow through the cell. In the present embodiment, the discharge current is produced by the discharge originating from the application of the first priming pulses $PP_x$ and $PP_y$, and then the discharge current passes through the switching current paths Px1, Py1 including the current limiters 20*a*, 20*b* connected to the cell in series, respectively, so that the amount of the discharge current is significantly limited by the current limiters 20*a* and 20*b*.

The pixel cell has a capacitive load due to the series connection of the current limiter to the switching current paths Px1, Py1, so that the potential variation appearing over each of the row electrodes $X_i$ and $Y_i$ has a leading edge which rises gradually when the first priming pulses are applied to the respective switching current paths Px1 and Py1, as shown in FIG. 9.

As mentioned above, the potential variation appearing over each of the row electrodes $X_x$, and $Y_i$ due to the application of the first priming pulses $PP_x$, $PP_y$ has the waveform in which a leading edge rises gradually, and the amount of the discharge current is lower. Accordingly, only a little amount of the discharge current flows through the pixel cell, so that the discharge energy in the pixel cell is reduced, thereby limiting the amount of charged particles generated in the discharge region 114. As a result, the luminance of the discharge emission having been generated by the application of the first priming pulse is lower than that of the conventional plasma display panel. It is possible to improve the contrast of the plasma display panel.

The pixel data pulse generator 12 then applies the pixel data pulses $DP_1$–$DP_n$ having positive potential and associated with the pixel data per row to the column electrodes $D_1$–$D_m$ in turn. In a preferred embodiment, the row electrode driving pulse generator 10*a* applies scan pulses SP which have relatively shorter pulse duration to the row electrodes $Y_1$–$Y_n$, synchronizing with the application of the data pulses $DP_1$–$Dp_n$. The row electrode driving pulse generator 10*a* applies second priming pulses PP which have positive potential as shown in FIG. 9 to the row electrodes $Y_1$–$Y_n$, just before the row electrode driving pulse generator 10*a* applies the scan pulses SP to the row electrodes $Y_1$–$Y_n$.

The number of charged particles which have been generated by means of the simultaneous priming is reduced gradually with the elapse of the time period. However, the application of the second priming pulse again generates or reproduces charged particles in the discharge region to leave the charged particles therein. Therefore, the scan pulses are applied to the row electrodes to write pixel data in the condition that a desired amount of charged particles is left in the discharge region 114.

If the contents of the pixel data equal a logical level of "0", both the scan pulse SP and the pixel data pulse DP are applied to the respective electrodes in the cell simultaneously, so that the barrier charge within the pixel cell is destroyed. If the contents of the pixel data equal a logical level of "1", only the scan pulse SP is applied to the electrodes in the cell, so that the barrier charge is kept with no changes. In other words, the scan pulse SP is a selective erasing pulse which triggers to selectively erase the barrier charge remaining within the pixel cell in accordance with the pixel data. (pixel data writing step)

Then, the row electrode driving pulse generator 10*a* applies a series of sustain pulses $IP_x$ having positive voltage to the row electrodes $X_1$–$X_n$, successively and applies a series of further sustain pulses $IP_y$ having positive voltage to the row electrodes $Y_1$–$Y_n$ successively at timings different from those for the sustain pulses $IP_x$. During the period in which the sustain pulses are applied successively, only the pixel cells that have the barrier charge maintain discharge emissions. (sustain discharge step)

When the generator 10*a* applies the sustain pulses to the row electrodes, it is noticed that the initial sustain pulse $IP_x$ being applied to the row electrode is set to have a wider pulse duration than that of the subsequent sustain pulses being applied to the row electrode. Writing the pixel data to the cell by the application of the pixel data and scan pulses is performed from the first row to the n-th row row-by-row in turn. Therefore, the different rows yield different periods from the writing of the pixel data to the sustain stage. Therefore, in the PDP, when the cells intended to have the logical level of "1" for holding the charged particles within the cells, it may happen that the amount of barrier charge and space charge left in the cell may be different from each other. In order to avoid this phenomenon, the initial sustain pulse applied has a wider time width, and the potential difference generated by the application of the wider sustain pulse is exerted over a pair of row electrodes during a longer period than that of the subsequent sustain pulse. As a result, a first sustain discharge terminates completely, and an amount of charged particles left in the pixel cell including the discharge region is substantially similar to that of other cells. The adjustment of the amount of electric charge in the pixel enables the PDP to display a clear image without undesired luminous variation.

Then, the row electrode driving pulse generator 10*a* applies erasing pulses EP to the respective row electrodes $Y_1$–$Y_n$ to cease the sustain discharges. (sustain discharge ceasing step)

Described above, in driving the plasma display panel, the first priming pulses are applied to all of the row electrodes simultaneously to perform a simultaneous priming operation, and the sustain pulses, the initial pulse having a wider pulse duration, are applied to the row electrodes, thereby enabling the emission display of the PDP.

Accordingly, the priming pulse having the waveform in which a leading edge rises gradually enables the reduction of the luminous intensity of the emission generated from the pixel cell by the application of the first priming pulses. Furthermore, The first sustain pulse applied has a wider pulse duration than those of the other sustain pulses, so that the charged particles within the cells having the same pixel data are similar to each other in the PDP.

In the preferred embodiment shown in FIG. 9, though the second priming pulse having positive voltage is applied to one of the pair of row electrodes and then the scan pulse having negative voltage is applied to the same electrode, it should be understood that the present invention is not limited to the above waveform charts and the constitutions.

Although the current limiters 20*a*, 20*b* are constituted of resistors in the above-described embodiment, it is understood that the current limiters should not be limited to resistors, but any element capable of limiting the amount of current flow may be used as the current limiters.

Figure 10:
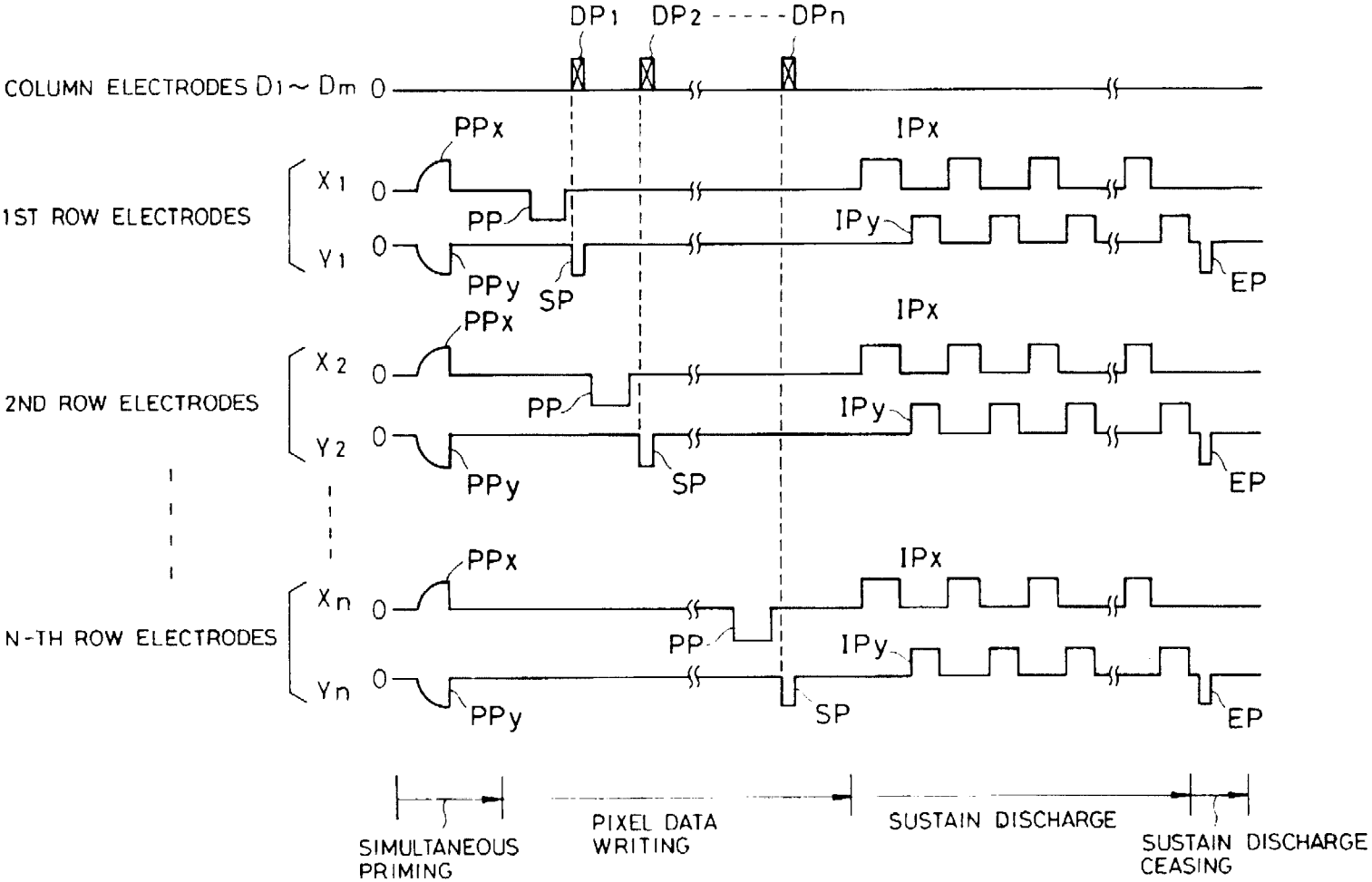
Figure 11:
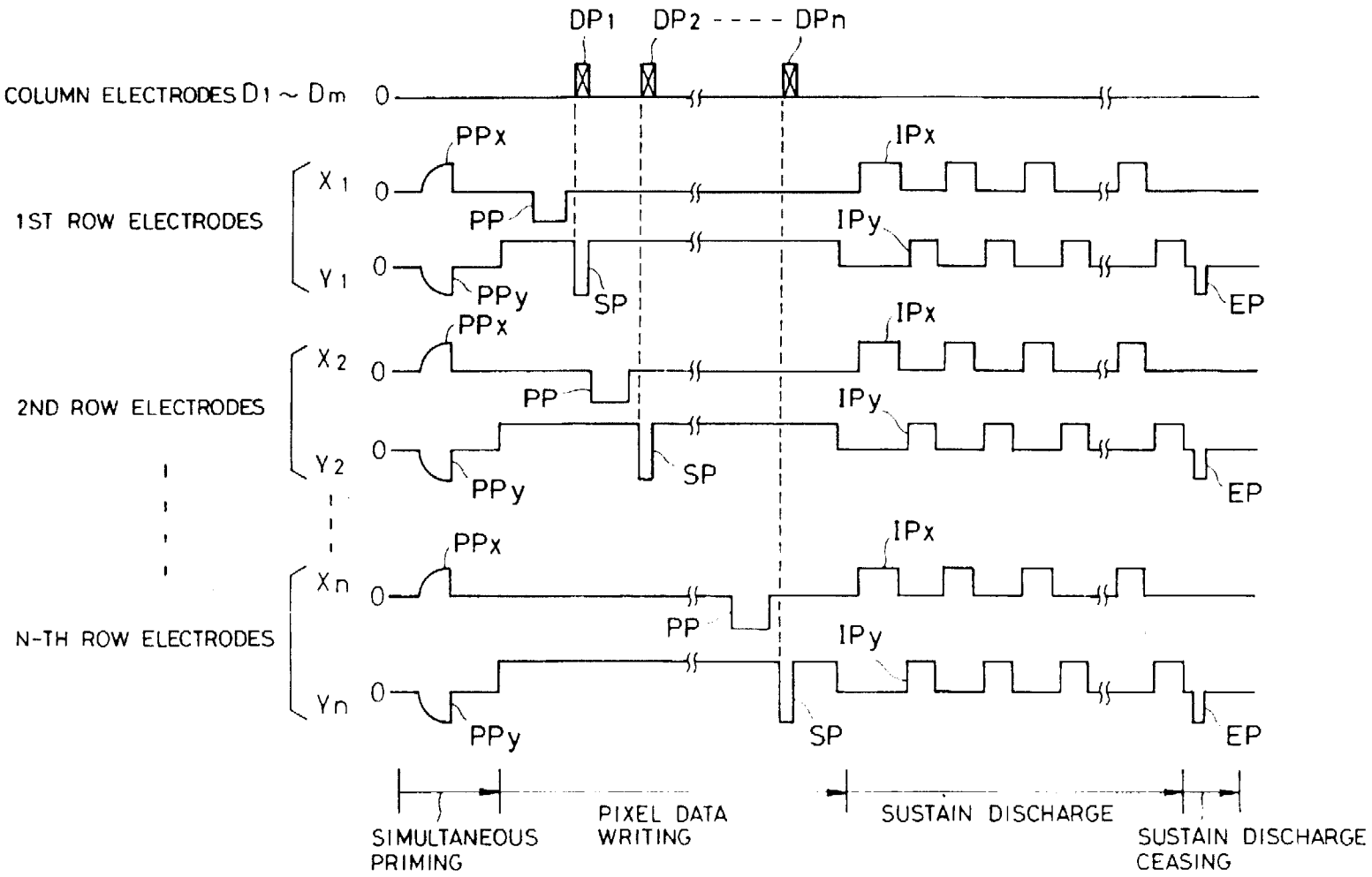

FIGS. 10 and 11 show waveform charts of the timings for applying the driving pulses by means of the driving technique as fifth and sixth preferred embodiments of the invention, respectively.

In the preferred embodiments shown in FIGS. 10 and 11, the row electrode driving pulse generator 10*a* serves to apply a second priming pulse having negative potential PP to the row electrode X of the pair, and then to apply a scan pulse having negative potential SP to the row electrode Y, thereby scanning the pixel data at every row.

Referring to FIG. 11, during the period in which the pixel data are written in the pixel cells by the application of the pixel data pulses $DP_1$–$DP_n$, the potentials of the row electrodes $Y_i$ are offset toward the positive side.

In all of the preferred embodiments described above, the barrier charge in the pixel cell is erased selectively, using the scan pulse having narrower pulse duration, thereby writing the pixel data to the pixel cell. However, conversely, it may be possible that the barrier charge in the pixel cell is generated selectively using the scan pulse having narrower pulse duration, thereby writing the pixel data to the pixel cell.

When the barrier charge is erased by the application of the scan pulse, a second priming pulse having narrower pulse duration is applied to cause the discharge between the pair of row electrodes for destroying all of the barrier charge within the pixel cell and for increasing the charged particles in the discharge region. Accordingly, similar priming advantages can be achieved in every row of the PDP. Then, during the pixel data writing step, the barrier charge is selectively generated in accordance with the pixel data.

In the preferred embodiments described above, after the simultaneous priming step is implemented by the application of the first priming pulses to all of the row electrodes, the second priming pulse is applied to the row electrode just before applying the scan pulse thereto for writing the pixel data, thereby writing the pixel data to the respective rows. In other words, the application of the second priming pulse adjusts the amount of charged particles in the discharge region of the pixel cell just before applying the scan pulse to write the pixel data. Therefore, the desired amount of barrier charge corresponding to the contents of the pixel data can be achieved in the pixel cell, thereby obtaining a precise display image on the PDP panel.

It is understood that the foregoing description and accompanying drawings set forth the preferred embodiments of the invention at the present time. Various modifications, additions and alternative designs will, of course, become apparent to those skilled in the art in light of the foregoing teachings without departing from the spirit and scope of the disclosed invention. Thus, it should be appreciated that the invention is not limited to the disclosed embodiments but may be practiced within the full scope of the appended claims.

What is claimed is:

1. A method for driving a matrix type of plasma display panel, said plasma display panel including a plurality of row electrodes extending parallel to each other, every two adjacent ones of said row electrodes being paired, and a plurality of column electrodes extending perpendicularly to said row electrodes at given intervals wherein a region in which one pair of said row electrodes and one said column electrode cross each other corresponds to one pixel, said method comprising the steps of:

applying first priming pulses to all of said row electrodes simultaneously to cause discharges between all of the pairs of said row electrodes, applying a second priming pulse to one selected row electrode of each of the pairs of said row electrodes to cause discharge between said paired row electrodes just before applying a scan pulse to the selected one of each pair of said row electrodes for writing pixel data to the associated pixels in accordance with pixel data pulses which are simultaneously applied to the column electrodes, and applying a series of sustain pulses alternately to one row electrode of each of the row electrode pairs and the other row electrode thereof to maintain sustain discharge between each of said paired row electrodes.

2. A method for driving a matrix type of plasma display panel, said plasma display panel including a plurality of row electrodes extending parallel to each other, every two adjacent ones of said row electrodes being paired, and a plurality of column electrodes extending perpendicularly to said row electrodes at given intervals wherein a region in which one pair of said row electrodes and one said column electrode cross each other corresponds to one pixel, said method comprising the steps of:

applying first priming pulses to all of said row electrodes simultaneously to cause discharges between all of the pairs of said row electrodes, applying a second priming pulse to one selected row electrode of each of the pairs of said row electrodes to cause discharge between said paired row electrodes just before applying a scan pulse to the other row electrode of the pair of said row electrodes for writing pixel data to the associated pixels in accordance with pixel data pulses which are simultaneously applied to the column electrodes, and applying a series of sustain pulses alternately to one row electrode of each of the row electrode pairs and the other row electrode thereof to maintain sustain discharge between each of said paired row electrodes.

3. The method according to claim 1 or claim 2, wherein said first priming pulse has a waveform in which a leading edge rises more gradually than that of one of the sustain pulses.

4. The method according to claim 1 or claim 2, wherein said sustain pulses are simultaneously applied to all of the pairs of the row electrodes in the plasma display panel, and wherein an initial one of said sustain pulses has a wider pulse duration than that of a later one of said sustain pulses.

5. A method for driving a matrix type of plasma display panel, said plasma display panel including a plurality of row electrodes extending parallel to each other, every two adjacent ones of said row electrodes being paired, and a plurality of column electrodes extending perpendicularly to said row electrodes at given intervals wherein a region in which one pair of said row electrodes and one said column electrode cross each other corresponds to one pixel, said method comprising the steps of:

applying first priming pulses having positive voltage to one selected row electrode of each of the pairs of said row electrodes and simultaneously applying further first priming pulses having negative voltage to the other row electrode of each of the pairs of said row electrodes to cause discharges between all of the pairs of said row electrodes, applying a second priming pulse having negative voltage to one selected row electrode of each of the pairs of said row electrodes to cause discharge between said paired row electrodes just before applying a scan pulse having negative voltage to the other row electrode of each pair of said row electrodes for writing pixel data to the corresponding pixels in accordance with pixel data pulses which are simultaneously applied to the column electrodes, with the other row electrode of each pair of said row electrodes having a positive offset voltage, and applying a series of sustain pulses having positive voltage alternately to one row electrode of each of the row electrode pairs and the other row electrode thereof to maintain sustain discharge between each of said paired row electrodes.

6. The method according to claim 5, wherein said first priming pulse has a waveform in which a leading edge rises more gradually than that of one of said sustain pulses.

7. The method according to claim 5 or claim 6, wherein said sustain pulses are simultaneously applied to all of the pairs of the row electrodes in the plasma display panel, and wherein an initial one of said sustain pulses has a wider pulse duration than that of a later one of said sustain pulses.

8. The method according to claim 1, further comprising the step of:

subsequent to said step of applying the series of sustain pulses, applying an erasing pulse to one row electrode of each of the pairs of said row electrodes.

9. The method according to claim 2, further comprising the step of:

subsequent to said step of applying the series of sustain pulses, applying an erasing pulse to one of the pair of row electrodes to stop the sustain discharge.

10. The method according to claim 5, further comprising the step of:

subsequent to said step of applying the series of sustain pulses, applying an erasing pulse having negative voltage to the other row electrode of the pair of row electrodes.

* * * * *